United States Patent [19]

Glanvall

[11] Patent Number: 4,720,250

[45] Date of Patent: Jan. 19, 1988

[54] REGULATOR FOR COOLING OR HEAT PUMP SYSTEMS

[75] Inventor: Rune Glanvall, Norrköping, Sweden

[73] Assignee: STAL Refrigeration AB, Norrköping, Sweden

[21] Appl. No.: 935,218

[22] Filed: Nov. 26, 1986

[30] Foreign Application Priority Data

Nov. 26, 1985 [SE] Sweden ..... 8505574

[51] Int. Cl.[4] ..... F01C 21/04; F04B 39/02

[52] U.S. Cl. ..... 418/84; 418/87; 418/88; 417/228

[58] Field of Search ..... 418/84, 87, 88, DIG. 1; 417/228, 281, 301; 184/6.22

[56] References Cited

U.S. PATENT DOCUMENTS

| | | | |
|---|---|---|---|
| 3,090,365 | 5/1963 | Constantino | 184/6.22 |
| 3,429,502 | 2/1969 | Lunduik | 417/228 |
| 3,448,916 | 6/1969 | Fraser | 418/84 |
| 4,180,986 | 1/1980 | Shaw | 418/84 |
| 4,276,966 | 7/1981 | Webb | 417/228 |
| 4,526,523 | 7/1985 | Parker | 418/88 |
| 4,639,196 | 1/1987 | Kirkland | 418/84 |

*Primary Examiner*—William L. Freeh

*Attorney, Agent, or Firm*—Watson, Cole, Grindle & Watson

[57] ABSTRACT

A rotary compressor in a cooling or a heat pump system which is provided with an oil injector and includes an oil separator on the high pressure side of the system. Oil is returned to the compressor for lubrication, cooling and sealing and is normally caused to circulate by means of the natural pressure differences in the cooling system. When the pressure level is too small to provide sufficient oil circulation, an oil pump is connected. By employing a pressure controlled regulating valve in the system, which serves both as a pressure regulating and a flow regulating valve, the oil pump may be caused to run idle when a sufficient pressure difference has been attained in the system.

2 Claims, 4 Drawing Figures

REGULATOR FOR COOLING OR HEAT PUMP SYSTEMS

FIELD OF THE INVENTION

The present invention relates to a regulating device in a cooling or heat pump system for controlling the oil pressure and the oil flow to a compressor provided with means for oil injection and having an oil store on its high pressure side.

BACKGROUND OF THE INVENTION

Cooling and heat pump systems with rotary compressors, primarily those having means for oil injection, normally include an oil separator located on the high pressure side of the system. This means that an oil store is subjected to the highest pressure of the system and by a suitable choice of the oil channel system, oil which is utilized for lubrication, cooling and sealing in the compressor may be caused to circulate by means of the "natural" pressure difference of the cooling system. Cooling and heat pump systems operate under very different operating conditions and also under such operating conditions in which this pressure difference is too small for a sufficient oil circulation. This may be the case, for example, in booster (low pressure) operation with certain cooling agents, but this may also occur, for example, during longer start up periods in systems having large condenser and/or evaporator volumes in relation to the capacity of the compressor. In these cases the oil circulation can be ensured by the connection of an oil pump. However, in addition to the intended properties of maintaining the pressure difference and the circulation, such an oil pump has certain negative properties, such as restricting the oil flow to the given pump capacity and constituting a loss source since it requires power for its operation. The restriction of the oil flow implies that it is necessary to choose a sufficiently large pump for the most unfavourable operating case, which may involve too great a pump capacity for the normal operation case, resulting in an unnecessarily great driving power.

The aim must be that the oil pump, if such is required, should not be larger than what is necessary with regard to the most unfavourable operating case and only be utilized where necessary. This objective can be fulfilled in many different ways, for example by means of shunting and valves with forced operation, which normally involves expensive solutions.

SUMMARY OF THE INVENTION

To reduce the power requirement of an oil pump, which provides an oil-injected rotary compressor in a cooling or heat pump system with oil for its lubrication, cooling and sealing, the oil pressure and the oil flow supplied to the pump are controlled by a regulator device comprising a pressure-controlled valve which serves both as a pressure-regulating and a flow-regulating valve and which causes the oil pump to run idle when a sufficient pressure difference has been achieved in the system.

DESCRIPTION OF THE PREFERRED EMBODIMENT

Figure 1:
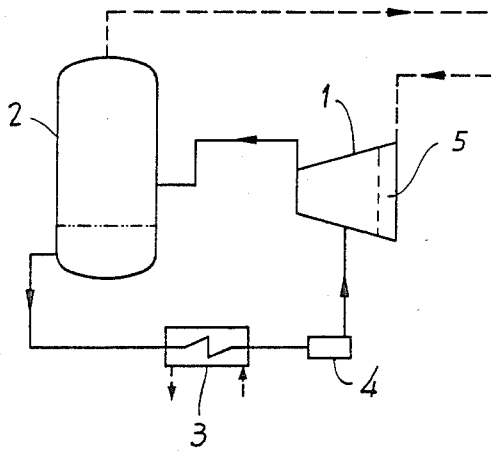
FIG. 1 shows an elementary diagram of an oil system in a cooling or heat pump system.
Figure 4:
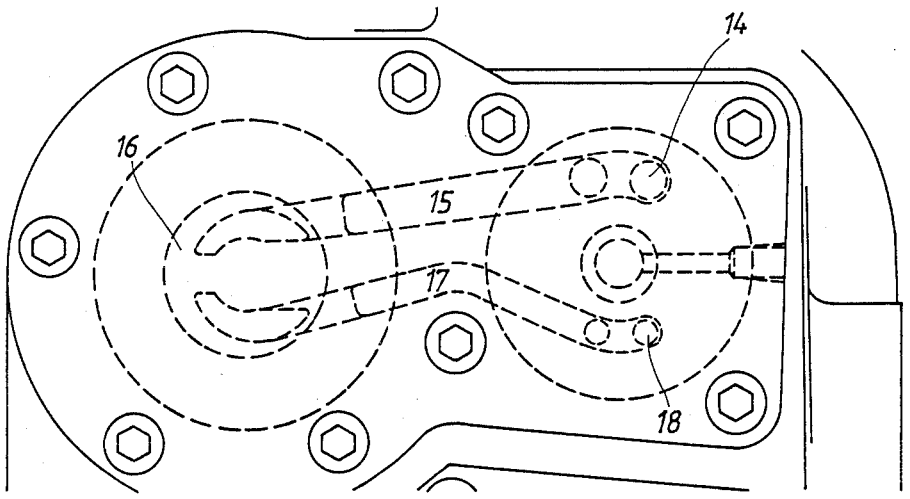
FIG. 4 shows the connections of the regulating valve to an oil pump.
Figure 2:
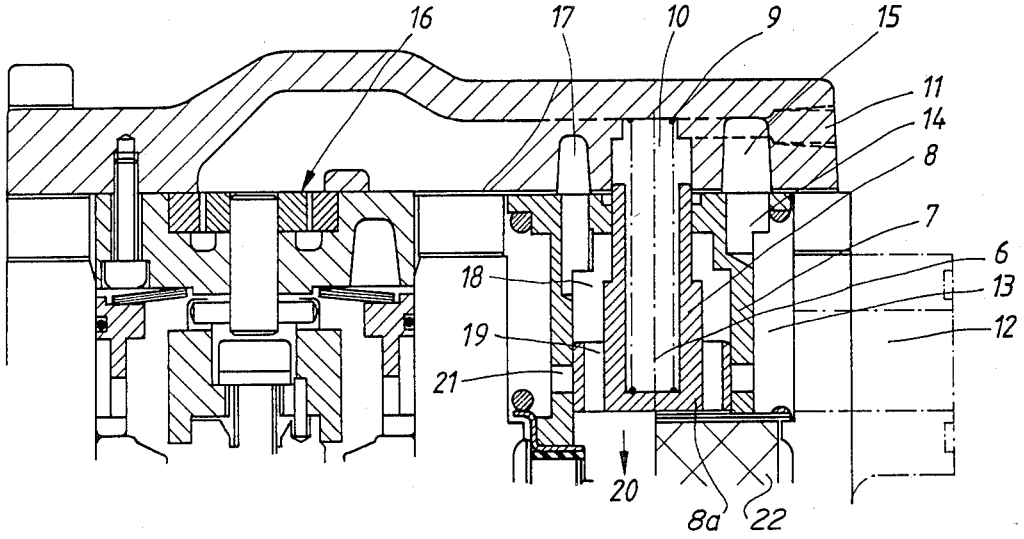
FIGS. 2 and 3 show a regulating valve in a regulator built into a part of a compressor of a cooling or heat pump system at normal and elevated pressures.
Figure 3:
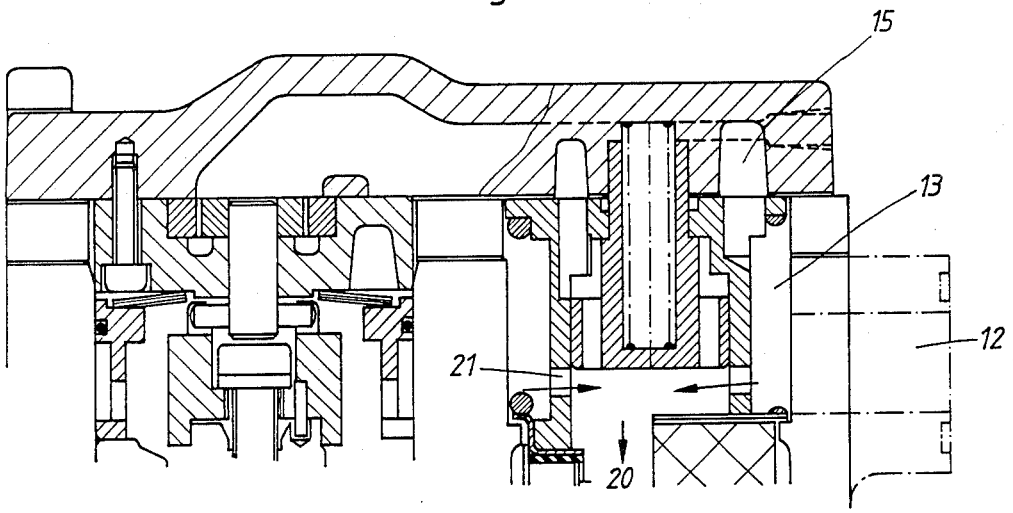

In the elementary diagram shown in FIG. 1, it is shown how a cooling agent in a cooling or heat pump system from an evaporator is passed to a compressor 1 and further, together with oil from the compressor 1, to an oil separator 2 and further to a condenser. The compressor 1 may be a rotary compressor having means for oil injection. The oil from the oil separator 2 is returned from the high pressure side of the system to the compressor 1 via an oil cooler 3 and an oil filter 4. Connected to the compressor 1 is a regulator device 5 for adjusting the minimum oil pressure and oil flow to the compressor 1. Referring to FIGS. 2 to 4, the regulator 5 mainly comnprises a regulating valve 6 which is designed as a pressure-controlled seat valve and is built into the compressor 1 and is directly connected to the oil filter 4, and an oil pump 16. The regulating valve 6 comprises a cylinder 7 with a piston 8 movable therein, the piston 8 being subjected to the action of a control pressure and an internally mounted spring 9 as well as of the input pressure. The oil from the high pressure side of the system is passed via the oil separator 2, the oil cooler 3 and the oil filter 4 to a connection 12 (at 5) on the compressor 1. The connection 12 leads to an annular space 13 surrounding the cylinder 7 of the regulating valve 6. The upper end 14 of the annular space 13 is connected to a connecting channel 15 leading to the oil pump 16. In this case, the oil pump 16 is of a positive displacement type and is operated with a constant speed and returns the oil to the compressor 1 with a certain pressure. Via a connection channel 17 the oil from the oil pump 16 is passed to a space 18 which is substantially defined by the wall of the cylinder 7 and the piston 8, the downwardly-facing head portion 8a of the piston 8 being provided with axial through-holes 19. The space 18 is thus connected to a space 20 downstream of the regulating valve 6, and the oil can be passed through the holes 19 at the end of the piston 8 of the regulating valve 6 to the compressor 1. The force from the spring 9 in the piston 8 and the pressure in the interior space 10 of the piston 8, where the pressure is dependent on a prevailing control pressure conveyed via a connection 11, urge the piston 8 to the lower position against an abutment element 22 shown in FIG. 2 involving passage of oil through the holes 19 at the end of the piston 8. However, if the input pressure of the oil reaches a certain specified level, the active area diffference of the piston 8 will cause the sum force, depending on the oil pressure, to become greater than the spring force and the force brought about by the prevailing control pressure, the piston 8 thus being urged to the upper position shown in FIG. 3. This causes the end of the piston 8 to expose bypass openings 21 in the wall of the cylinder 7, allowing oil to flow directly from the annular space 13 through the bypass openings 21 to the space 20 past the regulating valve 6. In this way, the oil pump 16 is bypassed at too high an input pressure, the pump thus running idle with a minimum power requirement and load.

When the input pressure is insufficient, the oil pump 16 maintains the pressure in the space 20 near the compressor 1, the regulating valve 6 operates as a normal pressure regulator and the oil flow corresponds to the pump capacity. The latter situation can occur during startup periods and in booster systems. When the input pressure has reached a certain specific level, the oil is passed directly to the space 20 near the compressor 1.

The oil flow is determined by the pressure differences of the system and the areas of the internal oil passageways. The size of the oil pump 16 is determined only by the minimum required oil flow to ensure operation of the compressor 1 under certain operating conditions.

What is claimed is:

1. A regulator device for controlling the oil pressure and oil flow to the high pressure side of a compressor from an oil store within a cooling or heat pump system, said regulator device comprising a regulating valve and an oil pump, said regulating valve including a cylinder which defines a first annular space therearound and which has an open end and by-pass openings therein near said open end, the open end of said cylinder being in communication to an outlet channel communicating with the high pressure side of said compressor, an inlet connection for supplying oil from said oil store to said annular space, an abutment element which covers a portion of the open end of said cylinder, a hollow piston which is movably positioned within said cylinder, said piston defining a second annular space between it and said cylinder and having a head portion which is abutable against said abutment element, said head portion, when positioned against said abutment element, closing said by-pass openings, and said head portion including axial holes therethrough which communicate said second annular space with said open end of said cylinder, a spring means biasing said piston towards said abutment element, connecting channels which extend from said first annular space to oil pump and from said oil pump to said second annular space, and a pressure channel for supplying a pressure fluid to the interior of said piston, the force of said pressure fluid and said spring on said piston opposing the force on said piston from the oil in said outlet channel, thereby determining the position of said piston in said cylinder and thus whether or not oil can flow through said by-pass openings directly to said outlet channel or to said outlet channel exclusively via said connecting channels and said oil pump.

2. The regulator device according to claim 1, wherein said spring means extends into the interior of said hollow piston.

* * * * *